US010130143B2

(12) United States Patent
Cavaliere et al.

(10) Patent No.: US 10,130,143 B2
(45) Date of Patent: Nov. 20, 2018

(54) ARTICLE OF FOOTWEAR WITH ADJUSTABLE CLEAT MEMBER

(71) Applicant: NIKE, Inc., Beaverton, OR (US)

(72) Inventors: Sergio Cavaliere, Venice (IT); Giovanni Adami, Montebelluna (IT)

(73) Assignee: NIKE, Inc., Beaverton, OR (US)

( * ) Notice: Subject to any disclaimer, the term of this patent is extended or adjusted under 35 U.S.C. 154(b) by 625 days.

(21) Appl. No.: 14/529,551

(22) Filed: Oct. 31, 2014

(65) Prior Publication Data

US 2016/0120265 A1 May 5, 2016

(51) Int. Cl.
*A43C 15/16* (2006.01)
*A43B 5/02* (2006.01)

(52) U.S. Cl.
CPC ..... *A43C 15/161* (2013.01); *A43B 5/02* (2013.01); *A43C 15/162* (2013.01)

(58) Field of Classification Search
CPC ..... A43B 5/02; A43C 15/161; A43C 15/162
See application file for complete search history.

(56) References Cited

U.S. PATENT DOCUMENTS 2,223,794 A * 12/1940 Pierce ..... A43C 15/161 36/59 R
3,352,034 A * 11/1967 Braun ..... A43C 15/162 36/67 D
3,577,663 A 5/1971 Mershon
5,243,775 A * 9/1993 Swain ..... A43B 13/26 36/127
5,628,129 A * 5/1997 Kilgore ..... A43C 13/04 36/126
5,644,830 A 7/1997 Ladouceur et al.
5,655,317 A * 8/1997 Grant ..... A43B 5/001 36/127
7,134,226 B2 11/2006 Robinson, Jr. et al.
7,428,790 B2 9/2008 Pellerin
7,823,301 B2 11/2010 Belluto
2002/0100190 A1 8/2002 Pellerin
2002/0178619 A1 12/2002 Schaudt et al.
2006/0242863 A1 11/2006 Patmore
(Continued)

FOREIGN PATENT DOCUMENTS

CN 1054889 A 10/1991
DE 102008025289 A1 12/2009
(Continued)

OTHER PUBLICATIONS

International Search Report and Written Opinion dated Mar. 30, 2016 in PCT/US2015/055852.
(Continued)

*Primary Examiner* — Ted Kavanaugh
(74) *Attorney, Agent, or Firm* — Honigman Miller Schwartz and Cohn LLP; Matthew H. Szalach; Jonathan P. O'Brien

(57) ABSTRACT

An article of footwear includes a cleat system with removable cleat members. The removable cleat members are fastened onto cleat receiving portions of a sole structure using fasteners. The removable cleat members can be placed at various angular positions and fastened in place to maintain the angular positions. The removable cleat members can be asymmetric to allow for different operating configurations of the cleat system.

15 Claims, 19 Drawing Sheets

(56) References Cited

U.S. PATENT DOCUMENTS

| | | | | |
|---|---|---|---|---|
| 2009/0077833 | A1* | 3/2009 | Kokavec | A43C 15/164 36/134 |
| 2012/0210608 | A1 | 8/2012 | Baker et al. | |
| 2013/0263478 | A1* | 10/2013 | Naparuano | A43C 13/04 36/134 |

FOREIGN PATENT DOCUMENTS

| | | | |
|---|---|---|---|
| EP | 0815759 | A2 | 1/1998 |
| FR | 2864883 | A1 | 7/2005 |
| JP | 2012-050815 | A | 3/2012 |
| WO | WO-2008018659 | A1 | 2/2008 |

OTHER PUBLICATIONS

Partial International Search Report dated Jan. 20, 2016 in PCT/US2015/055852.

State Intellectual Property Office (PRC), Office Action for CN Application No. 201580059525.5, dated Aug. 22, 2018.

* cited by examiner

ARTICLE OF FOOTWEAR WITH ADJUSTABLE CLEAT MEMBER

BACKGROUND

The present embodiments relate generally to articles of footwear, and in particular to articles of footwear with cleats.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure may include on or more cleat members. The cleat members provide traction for the article of footwear. The cleat members may engage a ground surface, such as dirt, turf or artificial surfaces.

SUMMARY

In one aspect, an article of footwear includes a sole structure with a cleat receiving portion, where the cleat receiving portion includes a first cavity. The article also includes a removable cleat member configured to engage the cleat receiving portion, where the removable cleat member includes a second cavity. The article includes a fastener configured to insert through the first cavity and into the second cavity to releasably secure the removable cleat member to the sole structure. The article also includes a radial locking system with a first plurality of radial locking elements disposed on a first engaging surface of the cleat receiving portion and a second plurality of radial locking elements disposed on a second engaging surface of the removable cleat member. The first plurality of radial locking elements engages the second plurality of radial locking elements when the second engaging surface of the removable cleat member is disposed against the first engaging surface of the cleat receiving portion. The radial locking system prevents rotation of the cleat about a central axis of the removable cleat member, while the removable cleat member is fastened to the sole member.

In another aspect, an article of footwear includes a sole structure with a cleat receiving portion, where the cleat receiving portion includes a first cavity. The article also includes a removable cleat member configured to engage the cleat receiving member, where the removable cleat member includes a second cavity. The article also includes a fastener configured to insert through the first cavity and into the second cavity in order to releasably secure the removable cleat member to the sole structure. The cleat receiving portion has a first engaging surface that is configured to contact a second engaging surface of the removable cleat member when the removable cleat member is fastened to the cleat receiving portion. A central axis of the fastener forms an oblique angle with the first engaging surface of the cleat receiving portion and the central axis of the fastener forms an oblique angle with the second engaging surface of the removable cleat member.

In another aspect, a removable cleat member configured to be removably fastened to an article of footwear includes a base portion and a top portion. The removable cleat member also includes an outer sidewall portion extending from the base portion to the top portion. The removable cleat member further has a central axis. The outer sidewall portion has a first height at a first angular position about the central axis and the outer sidewall portion has a second height at a second angular position about the central axis. The first height is greater than the second height.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
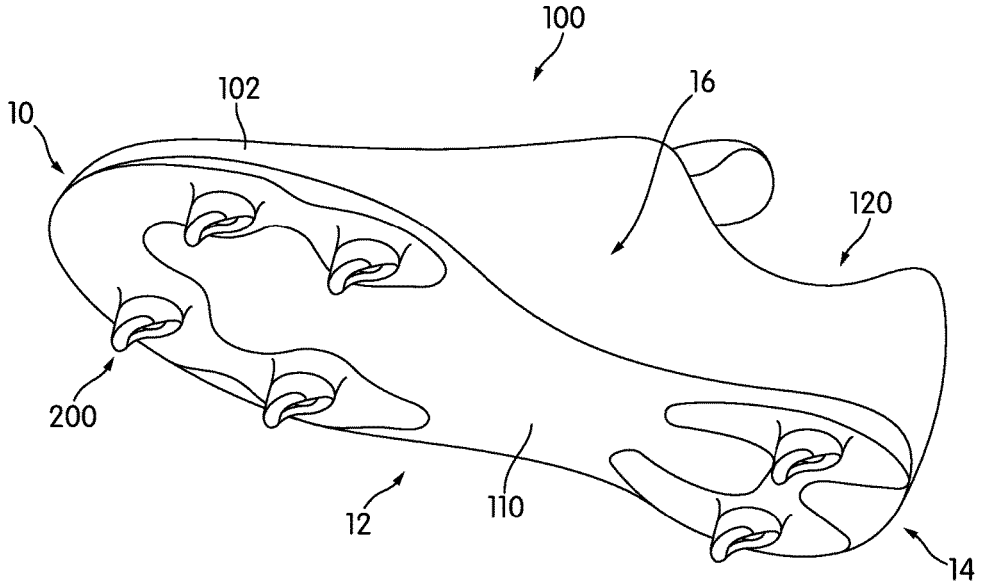
FIG. 1 is a schematic isometric bottom view of an embodiment of an article of footwear with multiple cleat members.

FIG. 1 is a schematic view of an embodiment of article of footwear 100. Although a single article is shown in the embodiments for purposes of clarity, embodiments may include a corresponding first article of footwear 100 and second article of footwear (not shown), configured for a left and right foot, respectively. Thus, it will be understood that the principles discussed herein may equally apply to another article of footwear corresponding to article of footwear 100.

Article of footwear 100, also referred to simply as article 100, may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured as various other kinds of non-sports related footwear, including, but not limited to: slippers, sandals, high heeled footwear, and loafers.

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see also FIG. 2). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. Moreover, throughout the embodiments, forefoot portion 10, midfoot portion 12, heel portion 14, lateral side 16 and medial side 18 may be used to refer to portions/sides of individual components of article 100.

For consistency and convenience, directional adjectives are employed throughout this detailed description corresponding to the illustrated embodiments. The term "longitudinal" as used throughout this detailed description and in the claims refers to a direction extending a length of a component (e.g., article of footwear 100). In some cases, the longitudinal direction may extend from a forefoot portion to a heel portion of the component. Also, the term "lateral" as used throughout this detailed description and in the claims refers to a direction extending along a width of a component. In some cases, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. This detailed description makes use of these directional adjectives in describing a sole structure and a cleat member of an article of footwear.

Article 100 may include an upper 102 as well as a sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

For purposes of illustration, only some components of upper 102 are shown and described. For example, upper 102 includes opening 120 that provides entry for the foot into an interior cavity of upper 102. In some embodiments, upper 102 may also include a tongue (not shown) that provides cushioning and support across the instep of the foot. Some embodiments may include fastening provisions, including, but not limited to: laces, cables, straps, buttons, zippers as well as any other provisions known in the art for fastening articles.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole.

Figure 2:
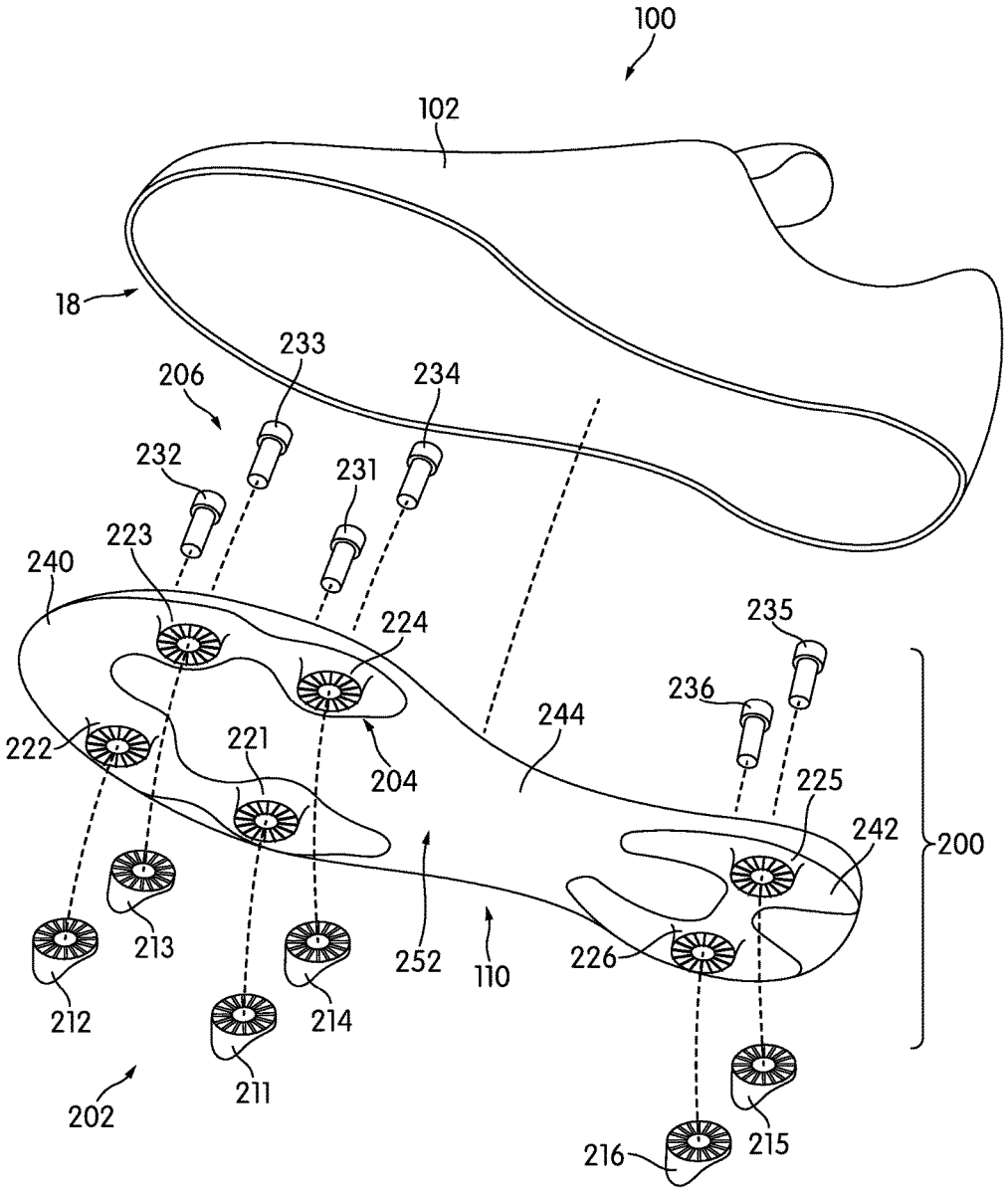
FIG. 2 is a schematic isometric exploded view of an embodiment of an article of footwear with multiple cleat members.

In the exemplary embodiment shown in FIGS. 1 and 2, sole structure 110 is seen to comprise an outer sole member 112. Outer sole member 112 could comprise a sole plate or similar component. In particular, outer sole member 112 could provide strength and/or support to a foot. Although not shown, some embodiments may include additional supporting layers such as a cushioning midsole and/or insole.

FIG. 2 illustrates a schematic isometric exploded view of an embodiment of article 100. Referring to FIGS. 1 and 2, article 100 may include a cleat system 200. In some embodiments, cleat system 200 may include one or more removable cleat members that may be removably fastened to one or more cleat receiving portions of sole structure 110. Generally, the term "removable cleat member" as used throughout this detailed description and in the claims includes any provisions that can be removably attached (fastened, etc.) to a sole structure to increase traction through friction or penetration of a ground surface. Removable cleat members may be configured for various kinds of activities, including sporting activities such as football, baseball, soccer, or any other kind of activity that requires traction with a ground surface. The term "cleat receiving portion" as used throughout this detailed description and in the claims refers to any provision associated with a sole structure or article that may be used to receive or otherwise engage a removable cleat member. In some cases, cleat receiving portions can be integrally formed with a sole structure. In other cases, however, cleat receiving portions could be separate from a sole structure and may be associated with the sole structure in a permanent (e.g., with adhesives or permanent fasteners) or non-permanent (e.g., with releasable fasteners) manner.

Referring now to FIG. 2, in one embodiment, cleat system 200 includes a set of removable cleat members 202. Set of removable cleat members 202 further comprises a first removable cleat member 211, a second removable cleat member 212, a third removable cleat member 213, a fourth removable cleat member 214, a fifth removable cleat member 215 and a sixth removable cleat member 216. Although the exemplary embodiment depicts six removable cleat members, in other embodiments set of removable cleat members 202 could comprise any other number of removable cleat members. For example, another embodiment could include less than six removable cleat members. Still another embodiment could include more than six removable cleat members.

Corresponding to set of removable cleat members 202, sole structure 110 is further associated with a set of cleat receiving portions 204. Set of cleat receiving portions 204 further comprises a first cleat receiving portion 221, a second cleat receiving portion 222, a third cleat receiving portion 223, a fourth cleat receiving portion 224, a fifth cleat receiving portion 225 and a sixth cleat receiving portion 226. Although the exemplary embodiment depicts six cleat receiving portions, in other embodiments set of cleat receiving portions 204 could comprise any other number of cleat receiving portions. For example, another embodiment could include less than six cleat receiving portions. Still another embodiment could include more than six cleat receiving portions.

In some embodiments, set of cleat receiving portions 204 are associated with raised peripheral structures. As seen in FIG. 2, for example, sole structure 110 may include a forefoot raised peripheral structure 240 and a heel raised peripheral structure 242. In some cases, these raised peripheral structures may be portions that are layered over a base plate or other component of sole structure 110. In other embodiments, raised peripheral structures could be integrally formed (e.g., molded with) with a base plate or other component of sole structure 110. In at least some embodiments, for example, forefoot raised peripheral structure 240 and heel raised peripheral structure 242 may be formed over a base plate 244 of sole structure 110 to achieve desirable geometries for set of cleat receiving portions 204.

As seen in FIG. 2, cleat system 200 may include a set of fasteners 206 that allow set of removable cleat members 202 to be secured to set of cleat receiving portions 204. Set of fasteners 206 may further include a first fastener 231, a second fastener 232, a third fastener 233, a fourth fastener 234, a fifth fastener 235 and a sixth fastener 236. Although the exemplary embodiment depicts six fasteners, in other embodiments set of fasteners 206 could comprise any other number of fasteners. For example, another embodiment could include less than six fasteners. Still another embodiment could include more than six fasteners.

Each fastener of set of fasteners 206 could comprise any kind of fastener. In different embodiments, different kinds of fasteners could be used. In one embodiment, depicted in FIG. 2, set of fasteners 206 comprise threaded fasteners. Examples of threaded fasteners include screws and bolts. However, in other embodiments, set of fasteners 206 could be any other kind of fasteners known in the art for attaching removable cleat members to a sole structure. Some alternative embodiments could utilize clip-type fasteners, snap in fasteners, or other kinds of mechanical fasteners that don't require a threaded shaft.

As best seen in FIG. 2, set of fasteners 206 are configured to be inserted through sole structure 110. In particular, set of fasteners 206 are inserted into openings in sole structure 110 on a first side 250 (see FIG. 11) of sole structure 100. Set of fasteners 206 then extend through openings in set of cleat receiving portions 204 on second side 252 of sole structure 110, in order to engage set of removable cleat members 202. This arrangement is discussed in further detail below and shown in FIGS. 11-13.

In the exemplary embodiments, cleat system 200 is configured with removable cleat members that are disposed within forefoot portion 10 and heel portion 14. Specifically, when assembled with sole structure 110, first removable cleat member 211, second removable cleat member 212, third removable cleat member 213, and fourth removable cleat member 214 are disposed in forefoot portion 10. Additionally, fifth removable cleat member 215 and sixth removable cleat member 216 are disposed in heel portion 14. This configuration is only intended to be exemplary and in other embodiments any other configuration, including a variety of different locations for removable cleat members, are possible. The location and total number of removable cleat members may be selected in various embodiments according to factors including, but not limited to: desired traction patterns, sole structure geometry, cleat member geometry, fastener type as well as possibly other factors.

Moreover, while the embodiments depict an article without any permanent (or "fixed") cleat members or other traction elements, other embodiments could incorporate a combination of both removable cleat members and fixed cleat members to achieve desired kinds and levels of traction.

Figure 3:
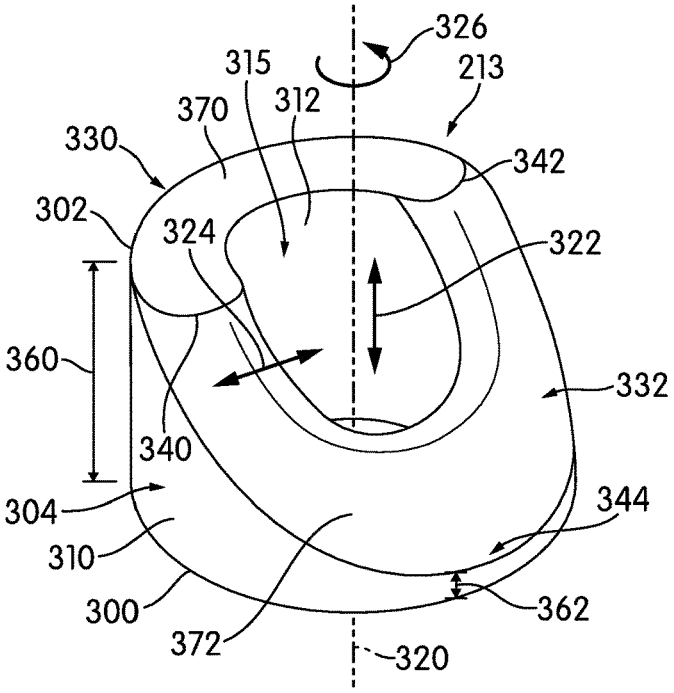
FIG. 3 is a schematic isometric view of an embodiment of a top portion of a cleat member.
Figure 4:
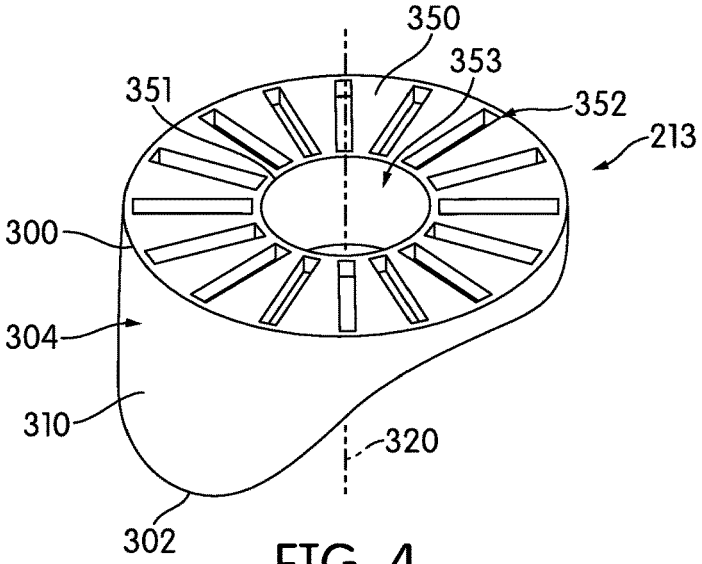
FIG. 4 is a schematic isometric view of an embodiment of a bottom portion of a cleat member.

FIGS. 3 and 4 illustrate a top isometric view and a bottom isometric view, respectively, of third removable cleat member 213. For purposes of clarity, some of the features of third removable cleat member 213 are described here in detail. However, it should be understood that the remaining removable cleat members of set of removable cleat members 202 may also share similar features. In some embodiments, for example, each removable cleat member in set of removable cleat members 202 could be substantially identical in geometry, material properties and/or other features. In other embodiments, however, two or more removable cleat members from set of removable cleat members 202 could be substantially different according to one or more features.

Referring to FIG. 3, third removable cleat member 213 may include base portion 300 and top portion 302. Base portion 300 may generally be disposed closer to sole structure 110, when third removable cleat member 213 is assembled with sole structure 110. In other words, base portion 300 may be proximal to top portion 302 when third removable cleat member 213 is disposed on sole structure 110.

An outer sidewall portion 304 may extend from base portion 300 to top portion 302. In some embodiments, outer sidewall portion 304 may form a ring-like structure such that a central portion 315 of third removable cleat member 213 is substantially hollow. In such an embodiment, depicted in FIG. 3, outer sidewall portion 304 may be further associated with an exterior sidewall surface 310 and an interior sidewall surface 312. In other embodiments, however, central portion 315 could be a material portion (e.g., not hollow).

Third removable cleat member 213 may be further associated with a central axis 320, which extends between base portion 300 and top portion 302 through the approximate center of third removable cleat member 213. Central axis 320 may define an axial direction 322, which is a direction oriented along central axis 320. Additionally, central axis 320 may be used to define a radial direction 324, which is a direction extending radially outwardly from central axis 320 (and therefore may be perpendicular to central axis 320 and axial direction 322). Further, third removable cleat member 213 may be associated with an angular direction 326 that defines an angular position of a portion about central axis 320.

In different embodiments, the geometry of base portion 300 could vary. In some embodiments, base portion 300 may comprise a generally rounded portion. In some cases, for example, base portion 300 could be approximately circular or elliptical. In other cases, however, base portion 300 could have any other geometry, including a polygonal prism geometry or an irregular geometry.

In order to characterize the geometry of third removable cleat member 213, some embodiments may be seen to have two or more distinct arc portions. In some embodiments, third removable cleat member 213 may have a first arc portion 330 and a second arc portion 332. First arc portion 330 may be characterized as extending from first angular position 340 to second angular position 342 in a clockwise direction about central axis 320. Also, second arc portion 332 may be characterized as extending from second angular position 342 back to first angular position 340 in the clockwise direction about central axis 320. In other words, first arc portion 330 and second arc portion 332 may be disjoint (or non-overlapping) portions that each extend between first angular position 340 and second angular position 342 along angular direction 326.

In some embodiments, the height of outer sidewall portion 304 may vary. In one embodiment, depicted in FIG. 3, the height of outer sidewall portion 304 may be substantially different in first arc portion 330 and second arc portion 332. Specifically, outer sidewall portion 304 may have a first height 360 in first arc portion 362. In some cases, outer sidewall portion 304 may have an approximately constant first height 360 throughout all of first arc portion 330. Additionally, outer sidewall portion 304 may have a variable height in second arc portion 332. For example, as indicated in FIG. 3, outer sidewall portion 304 may have a height that decreases between first height 360 at first angular position 340 and a second height 362 at a third angular position 344, which is also within second arc portion 332. This variability in height of outer sidewall portion 304 provides an asymmetric geometry for third removable cleat member 213.

In some embodiments, the geometry of top portion 302 may also vary at different angular positions of third removable cleat member 213. In some embodiments, top portion 302 may have an approximately horizontal first top surface 370 along first arc portion 330. As used herein, the term "horizontal" refers to a surface that is perpendicular to central axis 320 of third removable cleat member 213. In other words, a horizontal surface has a normal axis that is approximately parallel with central axis 320. In contrast, in some embodiments, top portion 302 may have a second top surface 372 that is angled (i.e., not perpendicular with) central axis 320. In particular, as seen in FIG. 3, second top surface 372 is substantially sloped from top portion 302 to base portion 300. Thus, the different orientations of first top surface 370 and second top surface 372 of top portion 302 provide an asymmetric surface orientation about central axis 320.

The asymmetric geometry of third removable cleat member 213 described above may allow for variations in the type of traction provided by third removable cleat member 213 according to the angular orientation of third removable cleat member 213 on sole structure 110. That the exemplary cleat system 200 is capable of being configured with removable cleat members having variable angular orientations is discussed in further detail below.

Referring now to FIG. 4, base portion 300 of third removable cleat member 213 may be associated with an engaging surface 350, which surrounds an opening 351 into a cavity 353 of third removable cleat member 213. In some embodiments, engaging surface 350 may be a surface configured to contact and engage a cleat receiving portion of sole structure 110. Engaging surface 350 may also include a first plurality of radial locking elements 352, which are discussed in further detail below.

Figure 5:
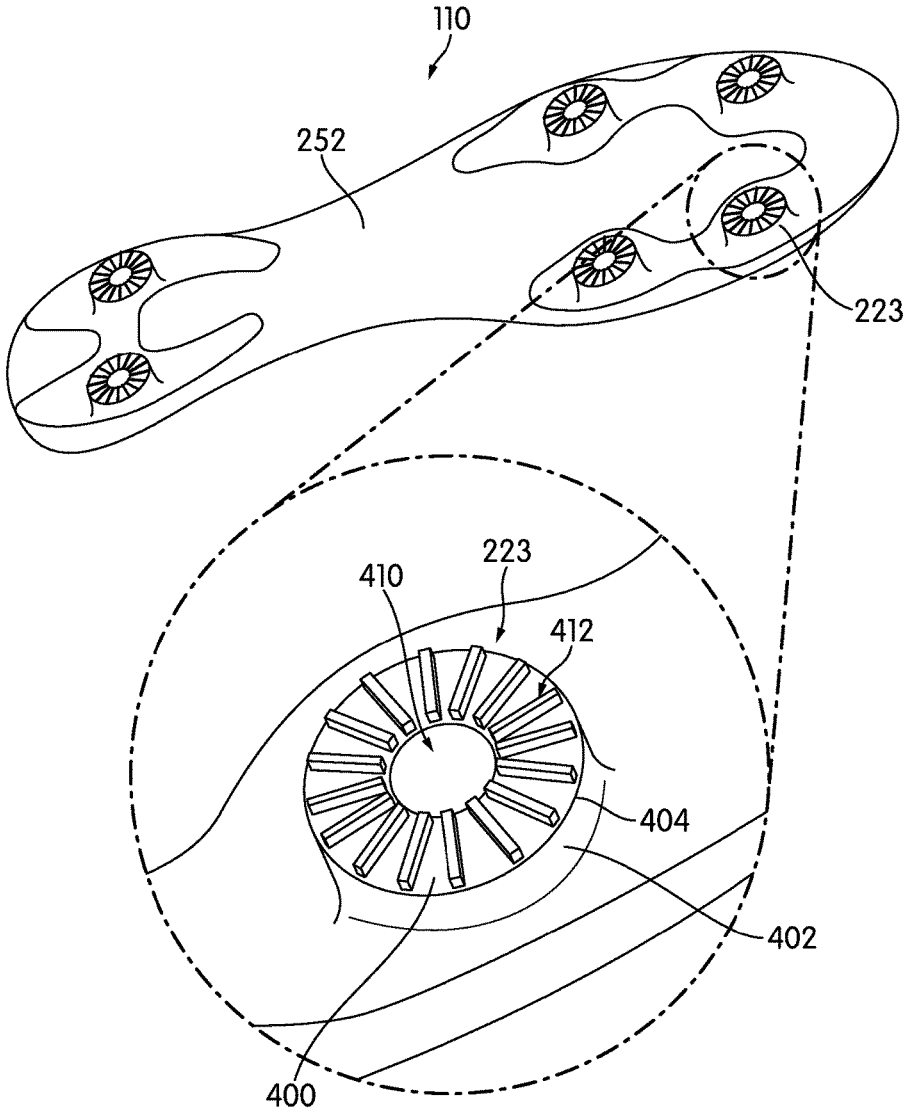
FIG. 5 is a schematic isometric view of an embodiment of a bottom side of a sole structure including an enlarged view of a cleat receiving portion.

FIG. 5 illustrates a schematic isometric view of a portion of third cleat receiving portion 223. For purposes of clarity, third cleat receiving portion 223 is shown in detail, however it will be understood that in at least some embodiments the remaining cleat receiving portions of set of cleat receiving portions 204 may share substantially similar features to first cleat receiving portion 221.

Referring to FIG. 5, third cleat receiving portion 223 may comprise an engaging surface 400 for receiving a corresponding removable cleat member. In some embodiments, third cleat receiving portion 223 also includes an outer sidewall portion 402 that extends at least partially around an outer perimeter 404 of third cleat receiving portion 223.

In the exemplary embodiment, engaging surface 400 is approximately round, to correspond with the rounded geometry of removable cleat members in set of removable cleat members 202. However, in other embodiments, engaging surface 400 could have any other geometry. Moreover, the geometry of engaging surface 400 in other embodiments could be selected according to the geometry of a corresponding removable cleat member, especially a corresponding engaging surface of the removable cleat member.

In some embodiments, third cleat receiving portion 223 includes an opening 410. In some embodiments, opening 410 provides access between first side 250 of sole structure 110 and second side 252 of sole structure 110. This configuration allows a fastener to be inserted through sole structure 110, including third cleat receiving portion 223, and into a corresponding opening in a removable cleat member. In other embodiments, however, opening 410 could be associated with an interior cavity that is not open on first side 250 of sole structure 110. In such alternative embodiments, a fastener could be inserted through a removable cleat member and then inserted into opening 410 to fasten the removable cleat member in place.

Embodiments can include provisions to help resist rotation of one or more removable cleat members, once the removable cleat members have been fastened into place at a desired angular position. In some embodiments, a cleat receiving portion and a removable cleat member can be configured with a radial locking system. In at least some embodiments, the radial locking system can include corresponding radial locking elements that may be positioned on the engaging surfaces of the cleat receiving portion and the removable cleat member.

Figure 6:
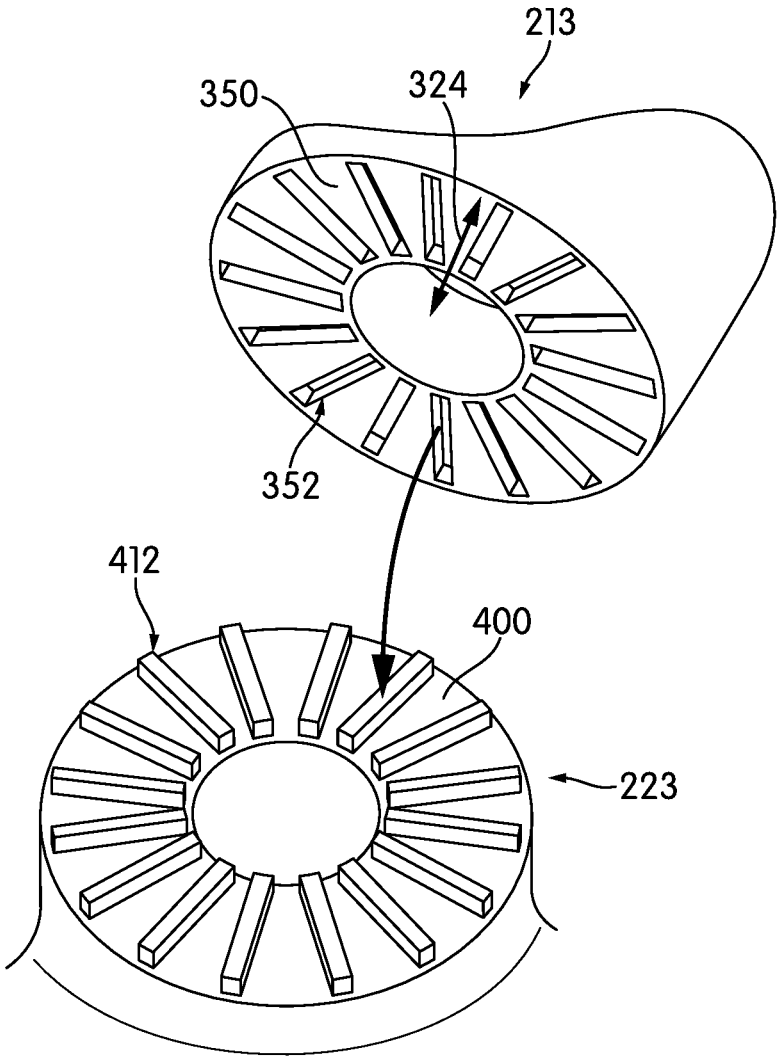
FIG. 6 is a schematic isometric view of an embodiment of a cleat member and a cleat receiving portion shown in isolation from the remainder of a sole structure.

FIG. 6 illustrates a schematic isometric view of an embodiment of third cleat receiving portion 223 and third removable cleat member 213. As shown in FIGS. 4-6, third removable cleat member 213 and third cleat receiving portion 223 may include corresponding radial locking elements, which together comprise a radial locking system or radial locking mechanism. Specifically, as best shown in FIG. 4 and FIG. 6, engaging surface 350 of third removable cleat member 213 may include a first plurality of radial locking elements 352. Plurality of radial locking elements 352 are features of engaging surface 350 that extend in radial direction 324. Also, as best shown in FIGS. 5 and 6, engaging surface 400 of third cleat receiving portion 223 includes a second plurality of radial locking elements 412.

In the embodiment shown in FIGS. 4-6, first plurality of radial locking elements 352 may be groove-like features that are recessed within engaging surface 350 of third removable cleat member 213. Also, second plurality of radial locking elements 412 may be raised features (e.g., ridges) that extend away from engaging surface 400 of third cleat receiving portion 223. However, in other embodiments, it will be understood that an engaging surface of a cleat receiving portion could include radial locking elements that are recessed (i.e., groove-like features). Likewise, in other embodiments, the engaging surface of a removable cleat member could include radial locking elements that are raised. Such an alternative configuration is shown, for example, in the embodiment of FIG. 16, which is described in further detail below.

In the exemplary embodiment, the corresponding ridges and grooves of the radial locking system have generally straight and rectangular cross-sectional geometries. However, in other embodiments, each radial element (including grooves and/or raised portions) could be straight or curved. Likewise, each radial element could be flat or contoured. Still further, in some embodiments, each radial element could be tapered.

Figure 7:
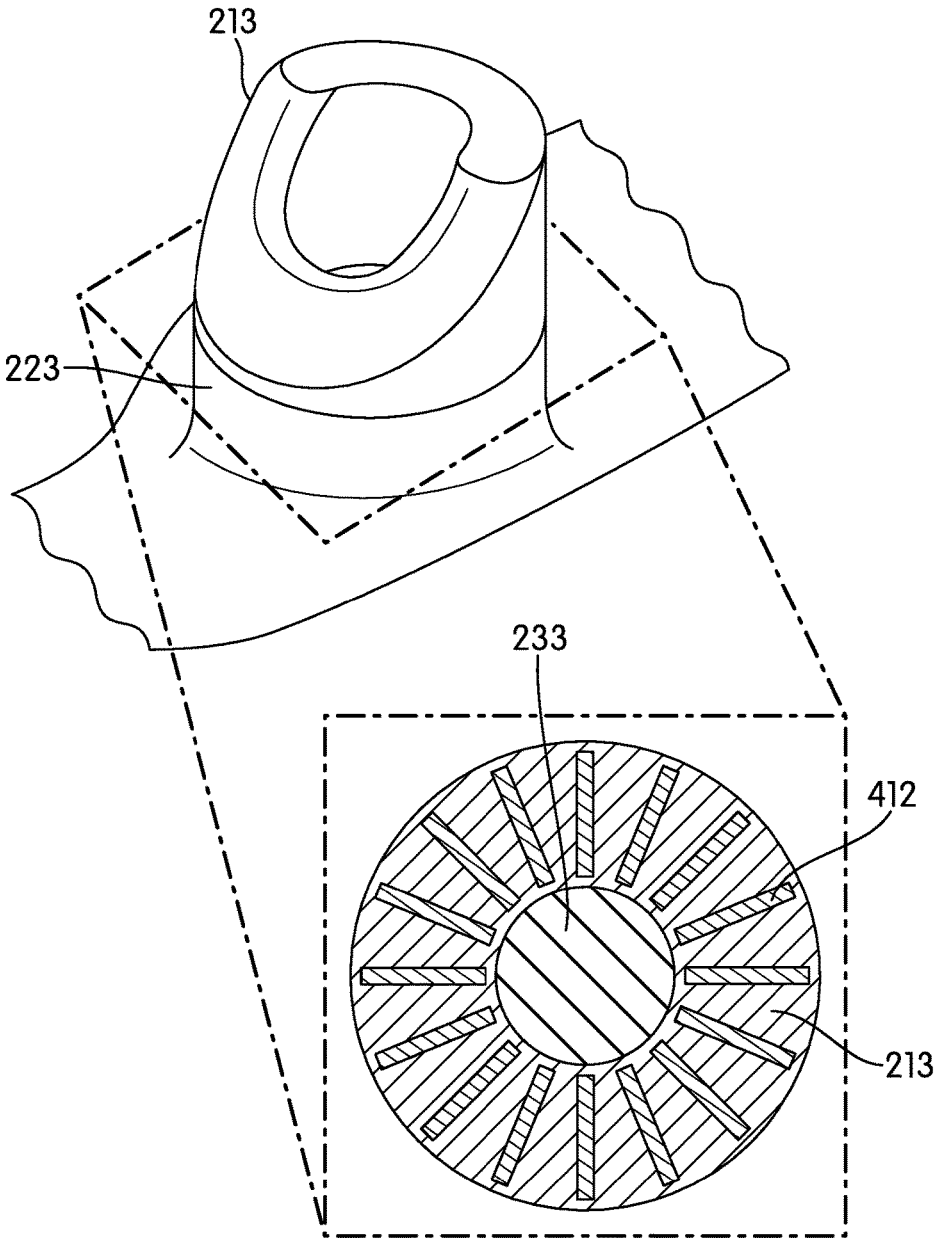
FIG. 7 is a schematic isometric view of an embodiment of a cleat member engaged with a cleat receiving portion including an enlarged cross-sectional view of portions of a radial locking system.

FIG. 7 illustrates a schematic isometric view and an enlarged cross-sectional view of third removable cleat member 213 engaged with third cleat receiving portion 223 according to an embodiment. Referring to FIG. 7, in this configuration second plurality of radial locking elements 412 are positioned within first plurality of radial locking elements 352. This arrangement helps to resist radial motion of third removable cleat member 213 relative to third cleat receiving portion 223, especially when third fastener 233 is used to fasten third removable cleat member 213 against third cleat receiving portion 223 in the axial direction.

Figure 8:
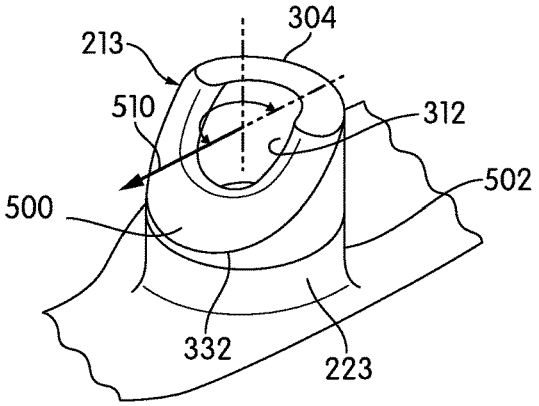
FIG. 8 is a schematic isometric view of an embodiment of a cleat member in a first angular position relative to a cleat receiving portion.
Figure 9:
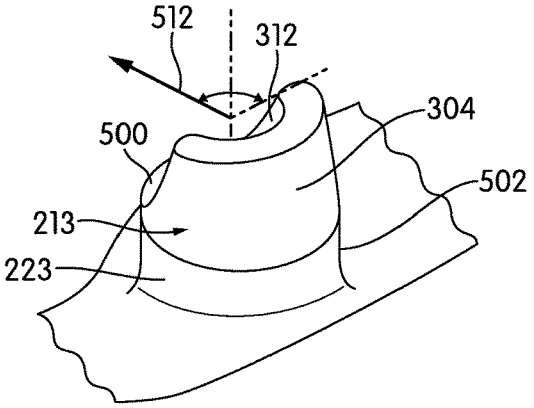
FIG. 9 is a schematic isometric view of the cleat member of FIG. 8 in a second angular position relative to the cleat receiving portion.
Figure 10:
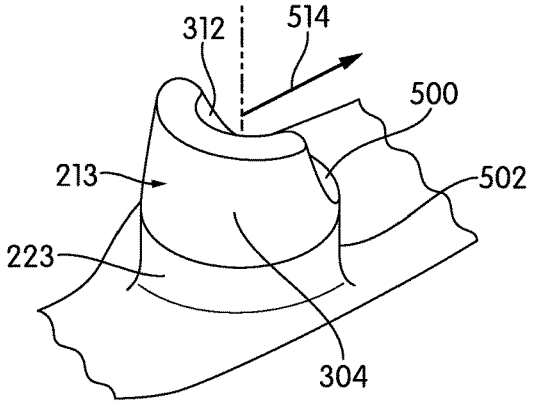
FIG. 10 is a schematic isometric view of the cleat member of FIG. 8 in a third angular position relative to the cleat receiving portion.

FIGS. 8-10 illustrate various orientations for a removable cleat member according to an embodiment. Referring to FIGS. 8-10, third removable cleat member 213 can be fastened to third cleat receiving portion 223 in approximately any angular orientation. As used herein, the term "angular orientation" refers to the angular position of a feature of a removable cleat member relative to a portion of a cleat receiving portion. For example, in the embodiments shown in FIGS. 8-10, the angular positions of third removable cleat member 213 are measured between a first cleat portion 500 of third removable cleat member 213 and a first receiving portion 502 of third cleat receiving portion 223. In this case, first cleat portion 500 corresponds to the approximate center of second arc portion 332 of third removable cleat member 213. Additionally, first receiving portion 502 corresponds to the forward most portion of third cleat receiving portion 223, where forward most is relative to sole structure 110. Of course, these portions are only used for purposes of convenience and other portions of a removable cleat member and a cleat receiving portion could be used for defining relative angular configurations.

In FIG. 8, first cleat portion 500 has a first angular position 510 relative to first receiving portion 502. In this first angular position 510, corresponding to approximately 180 degrees between first cleat portion 500 and first receiving portion 502, third removable cleat member 213 is oriented so that interior sidewall surface 312 of outer sidewall portion 304 is oriented towards a rearward end of sole structure 110. Such a configuration for third removable cleat member 213 may facilitate increased speed in the forwards direction.

In FIG. 9, first cleat portion 500 has a second angular position 512 relative to first receiving portion 502. In this second angular position 512, corresponding to approximately 90 degrees between first cleat portion 500 and first receiving portion 502, third removable cleat member 213 is oriented so that interior sidewall surface 312 of outer sidewall portion 304 is oriented laterally inwards, or towards a center of forefoot portion 10. Such a configuration may facilitate lateral motions, for example, the side stepping motions of a soccer player as the player dribbles the ball to the left or right.

In FIG. 10, first cleat portion 500 has a third angular position 514 relative to first receiving portion 502. In this third angular position 514, corresponding to approximately zero degrees between first cleat portion 500 and first receiving portion 502, third removable cleat member 213 is oriented so that interior sidewall surface 312 of outer sidewall portion 304 is oriented towards a forward end of sole structure 110. Such a configuration for third removable cleat member 213 may facilitate increased speed in the rearward direction. This orientation may enhance backpedaling speed, for example.

With an orientation for a removable cleat member selected, a fastener can be used to fasten the removable cleat member to a sole structure. More specifically, in some embodiments, the fastener may fasten the removable cleat member against the sole structure in a manner that maintains the selected orientation of the removable cleat member (e.g., without any further rotation of the removable cleat member).

Figure 11:
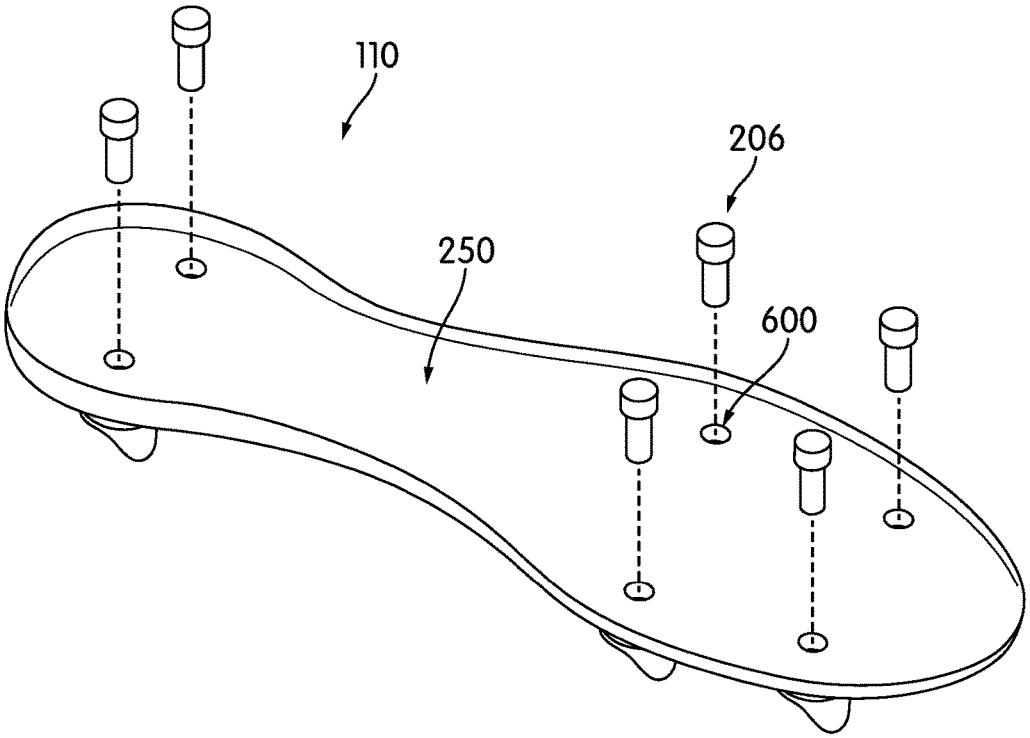
FIG. 11 is a schematic isometric view of an embodiment of a sole structure and a plurality of fasteners.

As seen in FIG. 11, which illustrates a schematic isometric view of first side 250 of sole structure 110, set of fasteners 206 may be inserted through a plurality of openings 600 on first side 250. For purposes of clarity, sole structure 110 is shown without other portions of article 100, such as upper 102. However, it will be understood that during use, a user may access first side 250 of sole structure 110 through an interior cavity of upper 102. Exemplary configurations that could be used for providing access to first side 250 are disclosed in Baker, U.S. Patent Publication Number 2012/0210608, published Aug. 23, 2012, now U.S. patent application Ser. No. 13/031,771, filed Feb. 22, 2011, and titled "Article of Footwear with Adjustable Cleats," the entirety of which is herein incorporated by reference.

Figure 12:
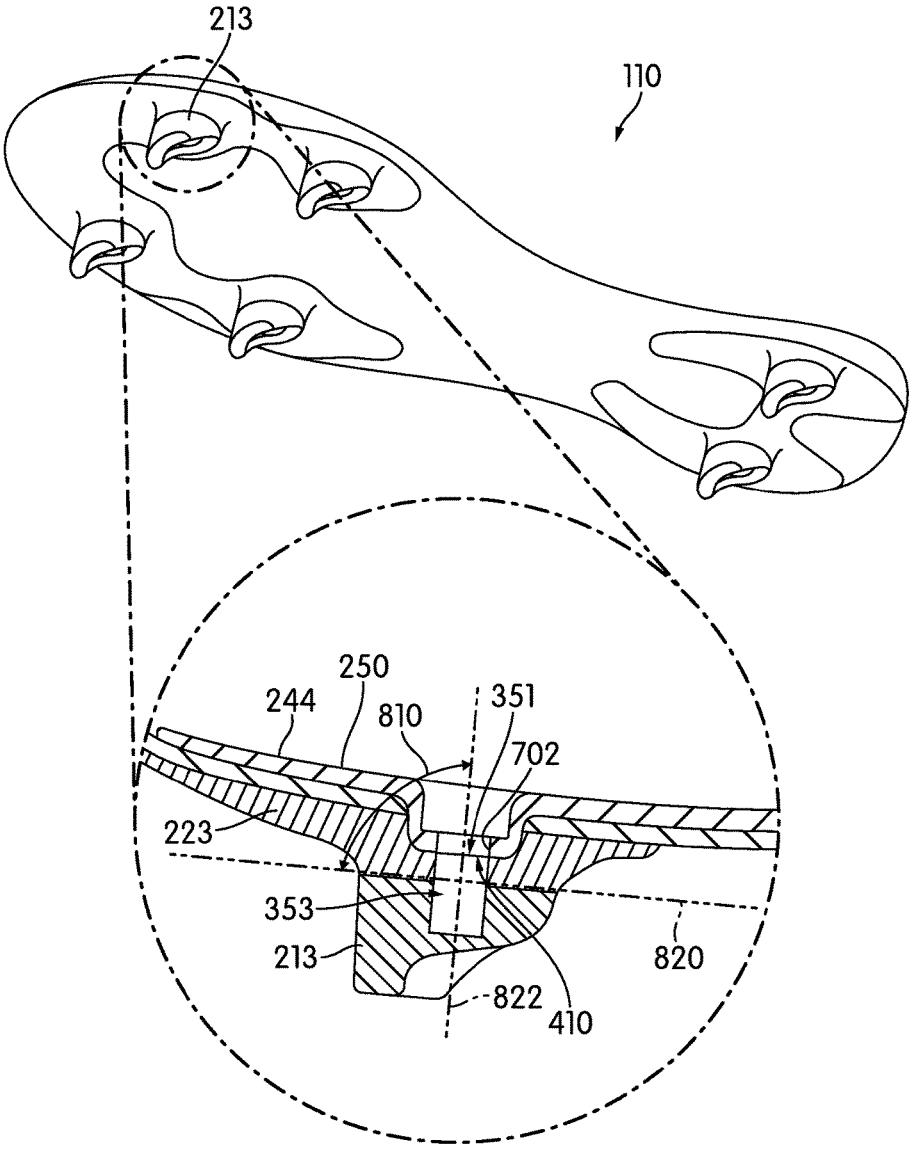
FIG. 12 is a schematic isometric bottom view of an embodiment of a sole structure and an enlarged cross-sectional view of a cleat member engaged with a cleat receiving portion.

FIG. 12 illustrates a schematic isometric side view of sole structure 110, including an enlarged cross-sectional view of third cleat receiving portion 223 and third removable cleat member 213 prior to the insertion of a fastener. Referring to FIG. 12, third cleat receiving portion 223 includes opening 410 that is aligned with opening 351 and cavity 353 of third removable cleat member 213. Moreover, in at least some embodiments, base plate 244 may include an opening 702 that is aligned with opening 410 of third cleat receiving portion 223. This configuration allows for a fastener to be inserted through first side 250 of sole structure 110, through third cleat receiving portion 223 and into third removable cleat member 213.

In some embodiments, cavity 353 of third removable cleat member 213 may be configured to engage a fastener. For example, in embodiments where a threaded fastener is used, cavity 353 may comprise a socket in third removable cleat member 213 that is threaded in a corresponding manner to allow the fastener to be tightened within third removable cleat member 213. In embodiments where other fastening mechanisms are used, cavity 353 may likewise comprise a socket with corresponding fastening provisions to receive a fastener. For example, in an alternative embodiment utilizing a fastener with projections or nubs, cavity 353 may comprise a socket with indentations, grooves or similar provisions to receive the projections or nubs such that the fastener is temporarily anchored in place within third removable cleat member 213.

Figure 13:
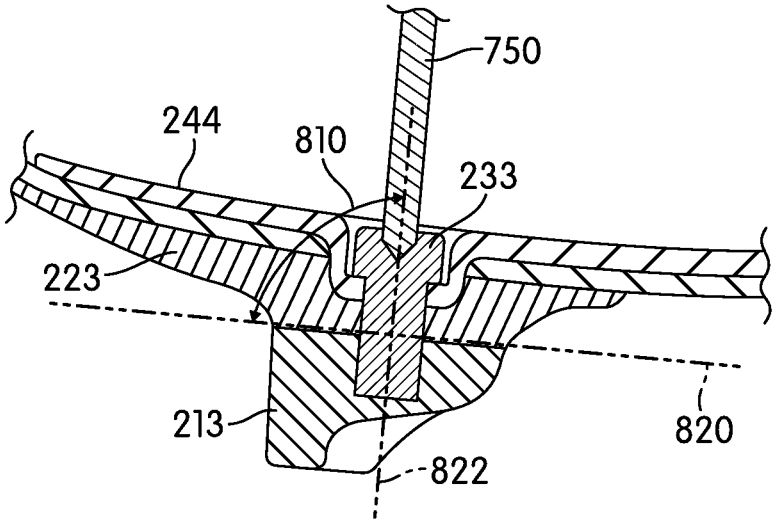
FIG. 13 is a schematic cross-sectional view of a portion of the sole structure of FIG. 12, in which a fastener has been inserted to fasten the cleat member to the cleat receiving portion.

FIG. 13 shows the enlarged view of FIG. 12 following the insertion of third fastener 233. As seen in FIG. 13, third fastener 233 may extend through base plate 244, third receiving portion 223 and third removable cleat member 213. As seen in FIG. 13, in some cases, third fastener 233 may be fastened in place using a fastening tool 750. In at least some embodiments, fastening tool 750 could be a screwdriver. In other embodiments, fastening tool 750 could be any other kind of fastening tool including a wrench (such as an Allen wrench) or a key.

In the embodiment shown in FIG. 13, third fastener 233 may be oriented in a perpendicular manner to a planar surface 820 associated with engaging surfaces of cleat receiving portion 223 and removable cleat member 213. In other words, third fastener 233, as well as cavity 353 of removable cleat member 213, form an approximately right angle with planar surface 820. As indicated in FIG. 13, a central axis 822 of third fastener 233 forms an approximate right angle 810 with planar surface 820.

Figure 14:
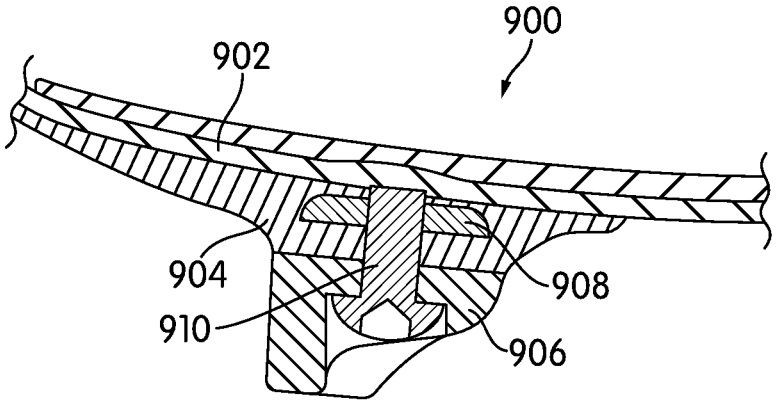
FIG. 14 is a schematic cross-sectional view of an embodiment of a portion of a sole structure in which a fastener is inserted through a cleat member and into a cleat receiving portion from a bottom side of the sole structure.

FIG. 14 illustrates another alternative configuration for a cleat fastening system. Specifically, FIG. 14 shows an enlarged cross-sectional view of a portion of a sole structure 900 including a base plate 902, a cleat receiving portion 904, a removable cleat member 906 and a fastener 910. In this embodiment, fastener 910 may be secured through an opening of removable cleat member 906 that is disposed outwardly on sole structure 900. Fastener 910 may further be secured within a closed ended cavity of cleat receiving portion 904. In this particular embodiment, the cavity or socket for receiving an end portion of fastener 904 is provided by an embedded threaded socket member 908.

The embodiment depicted in FIG. 14 may utilize other provisions taught with respect to the previous embodiments and shown in FIGS. 1-13. For example, in some embodiments, removable cleat member 906 and cleat receiving portion 904 may include a radial locking system, including corresponding sets of radial locking elements. Further, as with previous embodiments, removable cleat member 906 could be oriented in any direction and fastened in place in the desired orientation using fastener 910. Still further, in other embodiments, the geometry of removable cleat member 906 could vary in any manner. In at least some embodiments, removable cleat member 906 could have a similar geometry to the geometry of removable cleat member 213 discussed previously and shown in FIGS. 3 and 4.

Figure 15:
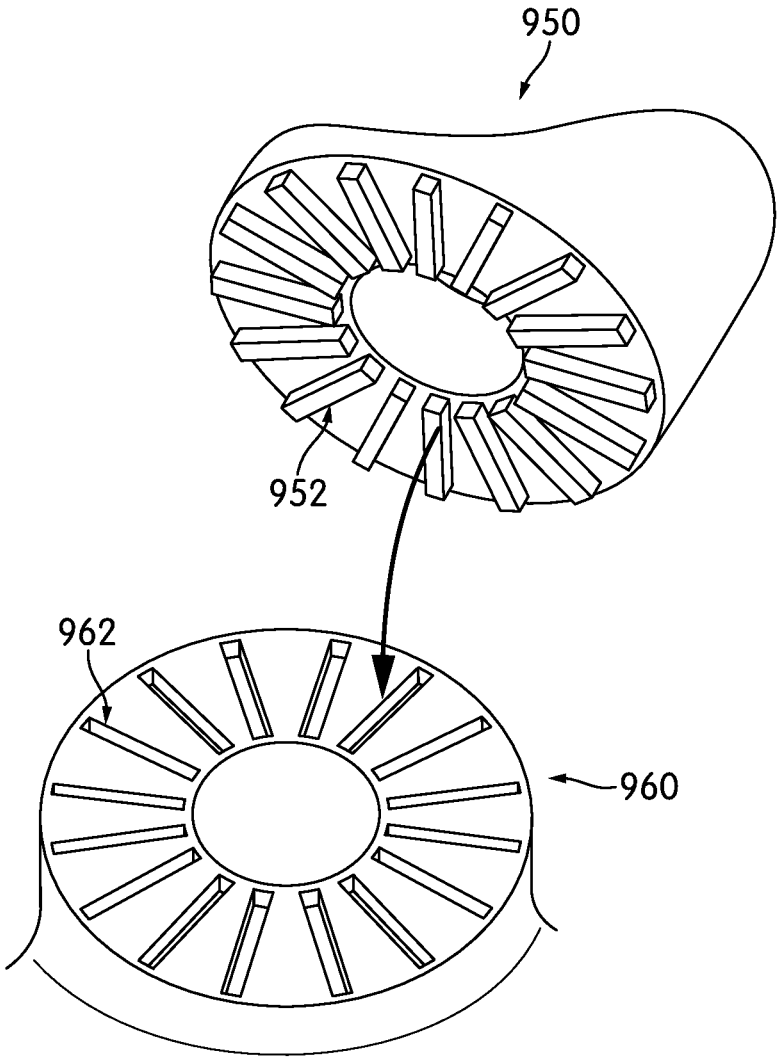
FIG. 15 is a schematic isometric view of an embodiment of a cleat member and a cleat receiving portion with an alternative radial locking system.

FIG. 15 illustrates an alternative configuration for a radial locking system. In FIG. 15, a removable cleat member 950 is configured to engage a cleat receiving portion 960. In this case, removable cleat member 950 may include a plurality of radial locking elements 952 in the form of raised ridges. Also, cleat receiving portion 960 may include a plurality of locking elements 962 in the form of grooves or recesses to receive the raised configurations of radial locking elements 952. As in previous embodiments, this alternative configuration for a radial locking system helps reduce the tendency of removable cleat member 950 to rotate once it has been secured to cleat receiving portion 960 with a fastener (not shown). It will be understood that such an alternative radial locking system could be used with any of the previous embodiments described above and shown in the figures.

Figure 16:
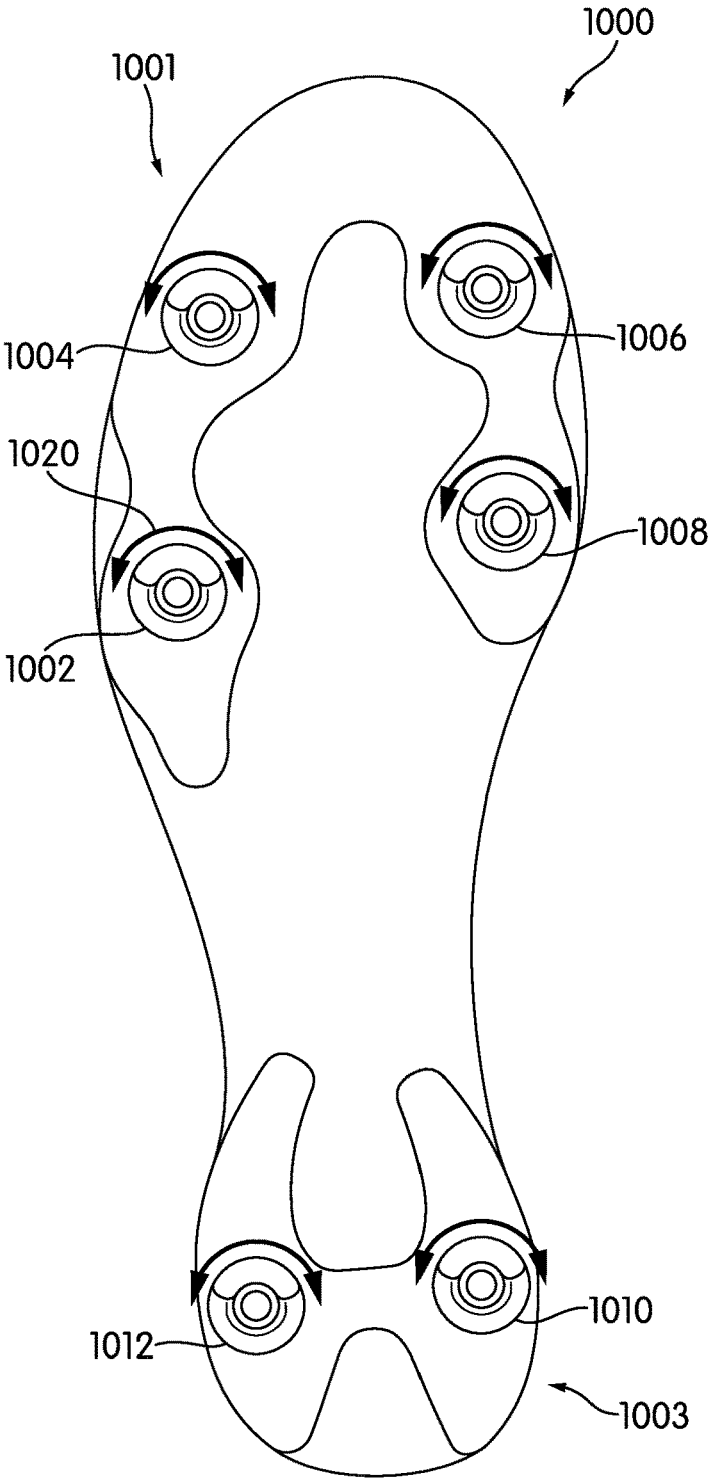
FIG. 16 is a schematic bottom view of an embodiment of a sole structure with multiple cleat members that can be configured in any angular positions.

FIG. 16 is a schematic bottom view of an embodiment of a sole structure 1000 including a plurality of removable cleat members. Referring to FIG. 16, sole structure 1000 includes first removable cleat member 1002, second removable cleat member 1004, third removable cleat member 1006 and fourth removable cleat member 1008, which are positioned in forefoot portion 1001 of sole structure 1000. In addition, sole structure 1000 includes fifth removable cleat member 1010 and sixth removable cleat member 1012, which are positioned in heel portion 1003 of sole structure 1000.

As indicated schematically in FIG. 16, each of the removable cleat members can be rotated to any angular positions prior to fastening the cleat members in place on sole structure 1000. For example, first removable cleat member 1002 can be rotated to any angular position along angular direction 1020. Moreover, each removable cleat member can be independently configured in a variety of different angular positions, such that some removable cleat members are oriented in various different directions during use.

Figure 17:
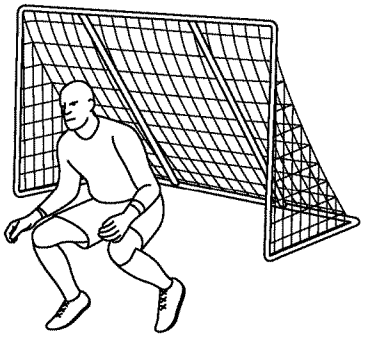
FIG. 17 is a schematic view of a player moving forwards towards a goal while wearing a sole structure with multiple cleat members configured in a manner that facilitates forward speed, according to an embodiment.
Figure 17:
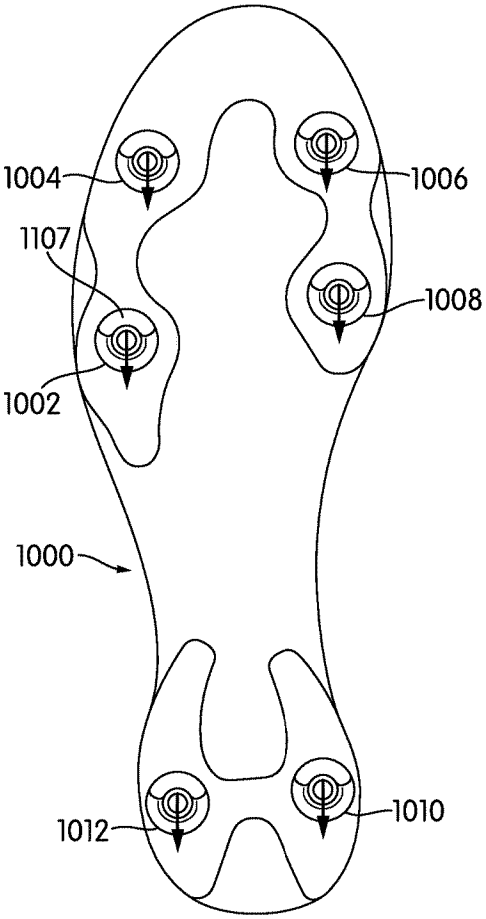

By varying the angular positions of one or more removable cleat members, a user can tune the traction and gripping properties of a sole structure to enhance athletic performance. For example, FIG. 17 illustrates a schematic view of an embodiment of a user 1100 that has selected a cleat configuration on sole structure 1000 of article 1102, which enhances forward speed. Specifically, as shown schematically in the enlarged view of sole structure 1000, each removable cleat member is configured such that the tallest portions of the cleat members (e.g., arc portion 1107 of first removable cleat member 1002) is positioned closest to a forward part of sole structure 1000. With this configuration, the corresponding arc portions of each removable cleat member may push against portions of dirt that are partially surrounded by the arc portions, which allows for increased push-off against the ground surface in the forward direction. As shown in FIG. 17, such a "forward speed" configuration could be useful for player 1100 who is playing a striker position in soccer.

Figure 18:
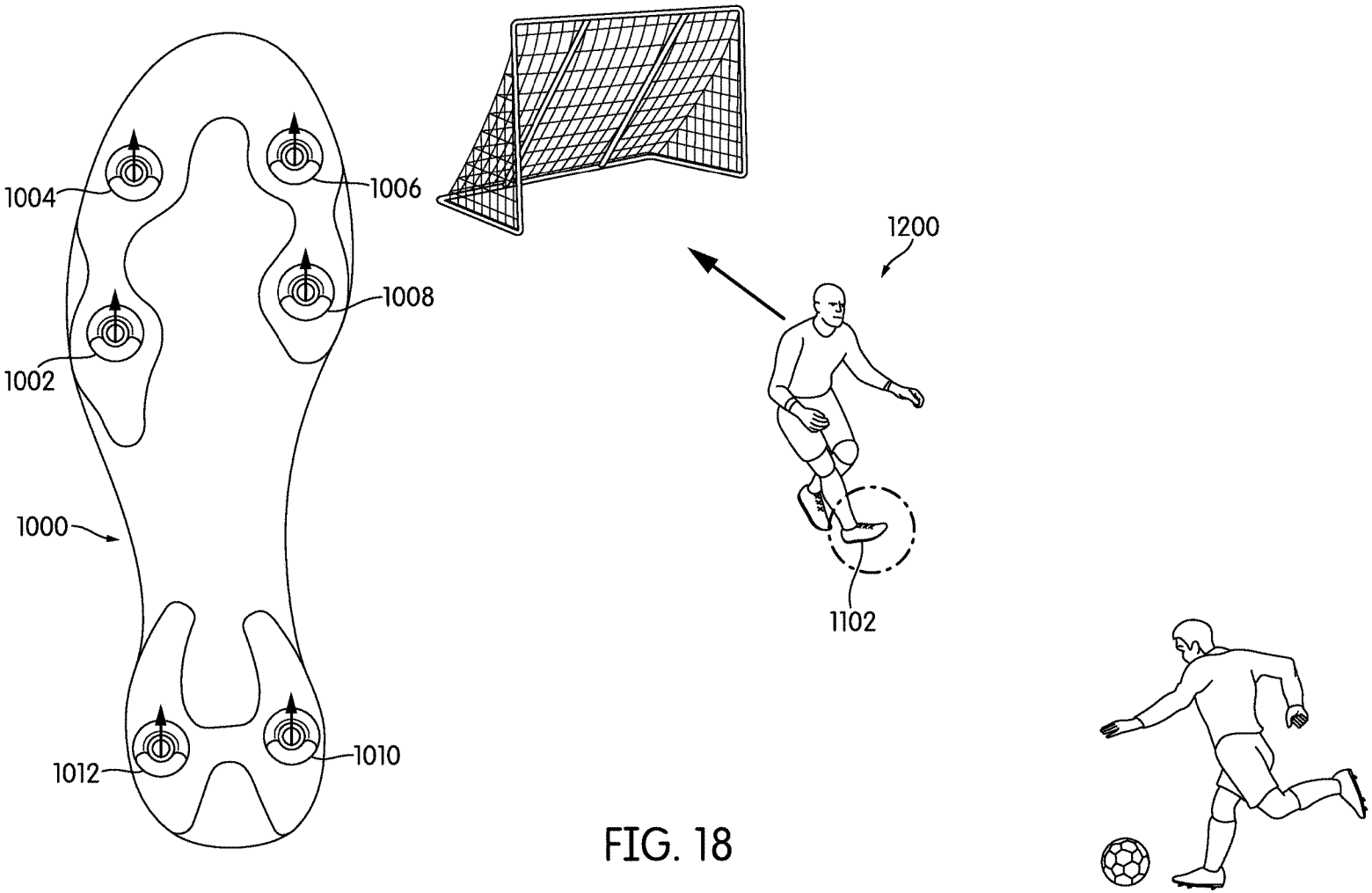
FIG. 18 is a schematic view of a player moving backwards towards a goal while wearing a sole structure with multiple cleat members configured in a manner that facilitates rearward speed, according to an embodiment.

FIG. 18 illustrates another situation where a player may optimize the traction on sole structure 1000. In FIG. 18, player 1200 may also be wearing article 1102, which includes sole structure 1000. However, in this situation, the removable cleats on sole structure 1000 have been configured in orientations such that the taller arc portions are disposed closest to a rearward portion of sole structure 1000. This particular cleat configuration may therefore enhance backward speed or backpedaling speed. Because the removable cleat members are oriented in this direction, the corresponding arc portions of each removable cleat member may push against portions of dirt that is partially surrounded by the arc portions, which allows for increased push-off against the ground surface in the rearward direction. As shown in FIG. 18, such a "backward speed" configuration could be useful for a player in a defensive position, since defensive players may need to face their opponents and travel backwards as their opponents advance.

Figure 19:
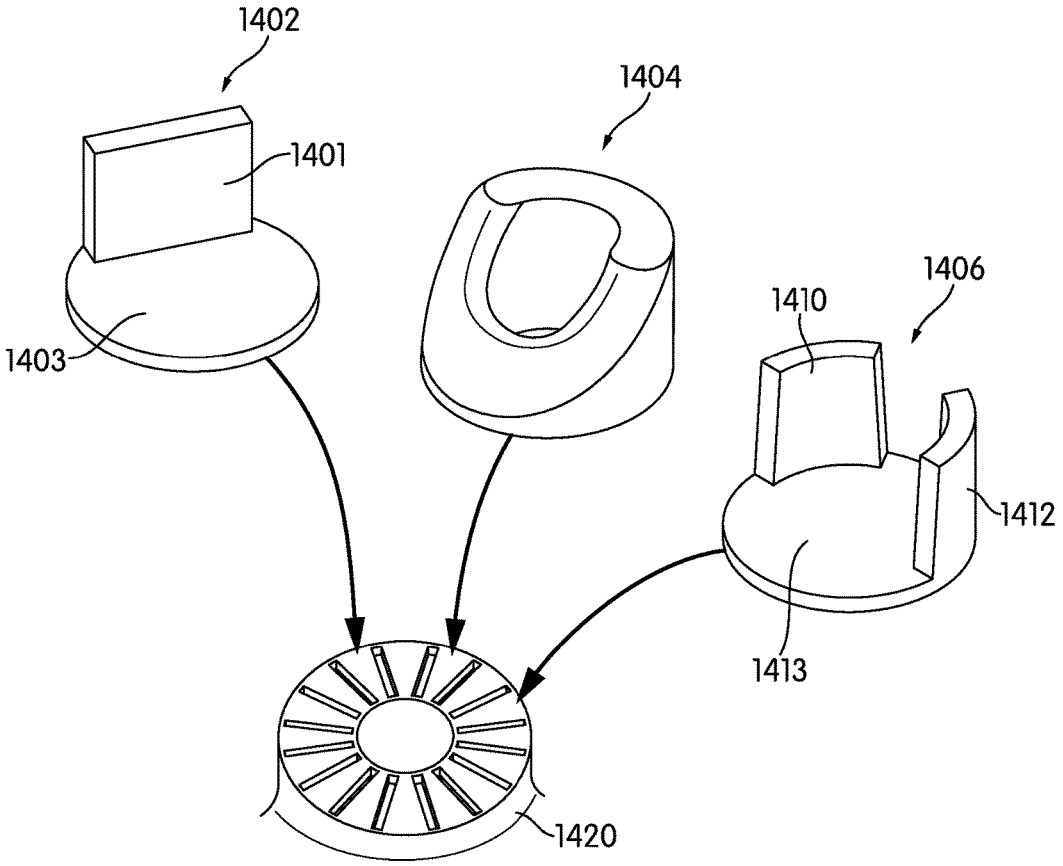
FIG. 19 is a schematic isometric view of a plurality of removable cleat members having different geometries.

The geometry of a removable cleat member can vary in different embodiments. For example, FIG. 19 illustrates several exemplary geometries for different removable cleat members that could be used with any of the embodiments discussed herein and shown in the figures. As seen in FIG. 19, a first removable cleat member 1402 has a ridge-like geometry. Specifically, first removable cleat member 1402 includes a base portion 1403 and a ridge portion 1401. Base portion 1403 may include provisions for engaging a cleat receiving portion 1420, such as radial locking elements or other features. Also, base portion 1403 could include provisions for receiving a fastener. Ridge portion 1401 is arranged at a predetermined angular position of base portion 1403, and therefore the angle of ridge portion 1401 relative to a sole can be varied by rotating the position of base portion 1403 at cleat receiving portion 1420.

A second removable cleat member 1404 has a truncated geometry similar to the embodiments described above and shown for example in FIGS. 3-4. Second removable cleat member 1404 may be configured with provisions to attach to cleat receiving portion 1420.

A third removable cleat member 1406 has a segmented geometry, including a first outer segment 1410 and a second outer segment 1412. Here, first outer segment 1410 and second outer segment 1412 may be arranged in an asymmetric configuration on a base portion 1413 of third removable cleat member 1406. Base portion 1413 can include provisions for engaging cleat receiving portion 1420.

It will be understood that the geometries of each removable cleat member may generally be asymmetric about an angular direction to provide for different physical configurations when the removable cleat members are rotated through different angular positions with respect to a corresponding cleat receiving member 1420. Thus it will be understood that the geometry of a removable cleat member can vary. Moreover, in some embodiments, two different removable cleat members for a single sole structure can have distinct geometries (i.e., some may be ridge-like while others may be rounded). Cleat geometries can be selected according to various factors including, but not limited to: intended sport/activity, intended position (e.g., a offensive position or a defensive position), the type of ground surface on which the article will be used as well as possibly other factors.

Figure 20:
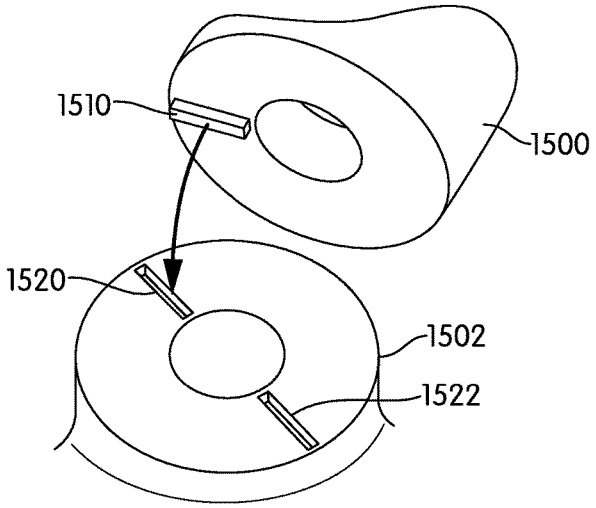
FIG. 20 is a schematic isometric view of an embodiment of a removable cleat member and cleat receiving portion with a radial locking system allowing for two different angular positions of the removable cleat member on the cleat receiving portion.

Embodiments can be configured to provide a smaller set of discrete angular cleat orientations. For example, FIG. 20 illustrates an embodiment of a removable cleat member 1500 and a corresponding cleat receiving portion 1502. In this case, removable cleat member 1500 is configured with a single radial locking element 1510, which can engage one of a first radial locking element 1520 or a second radial locking element 1522 on cleat receiving portion 1502. Here, radial locking element 1510 is a raised element while radial locking element 1520 and radial locking element 1522 are grooves.

Figure 21:
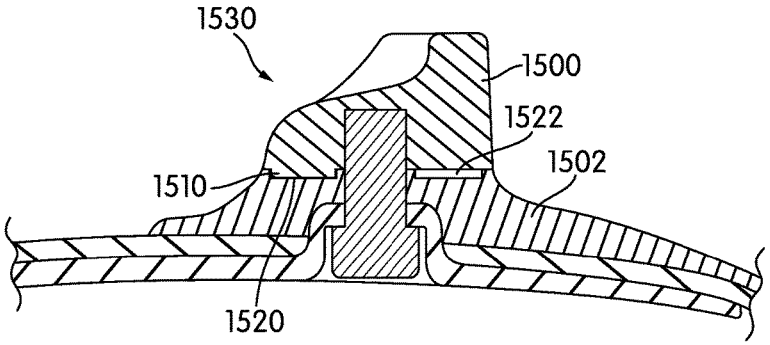
FIG. 21 is a schematic cross-sectional view of the removable cleat member of FIG. 20 in a first angular position.
Figure 22:
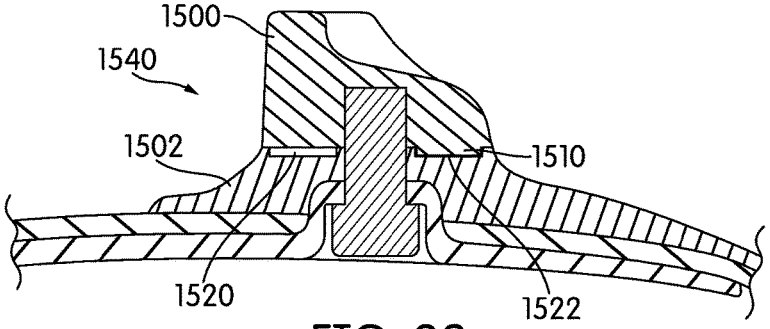
FIG. 22 is a schematic cross-sectional view of the removable cleat member of FIG. 20 in a second angular position.

As seen in FIGS. 21-22, which illustrate enlarged cross-sectional views of the assembly of removable cleat member 1500 with cleat receiving portion 1502, this radial locking configuration provides for two possible cleat orientations. In a first orientation 1530, shown in FIG. 21, radial locking element 1510 engages radial locking element 1520. In a second orientation 1540, shown in FIG. 22, radial locking element 1510 engages radial locking element 1522. As seen here, first orientation 1530 is related to second orientation 1540 by a rotation of approximately 180 degrees.

Of course, other embodiments can use any number of radial locking elements on a removable cleat member and a cleat receiving portion to provide for various discrete angular orientations/positions of a removable cleat member on a sole structure. Providing at least three radial locking elements (e.g., grooves) on a cleat receiving member, for example, may allow for three distinct angular orientations. These orientations may be evenly spaced, or alternatively could be unevenly spaced.

It is contemplated that a removable cleat member can be secured to a cleat receiving portion using other fastening configurations. For example, some other embodiments could use angled fastening configurations. In order to accommodate angled fastening configurations, some embodiments may utilize removable cleat members with multiple fastener receiving cavities, such that in different angular orientations of the removable cleat member, different cavities may receive a corresponding fastener.

Figure 23:
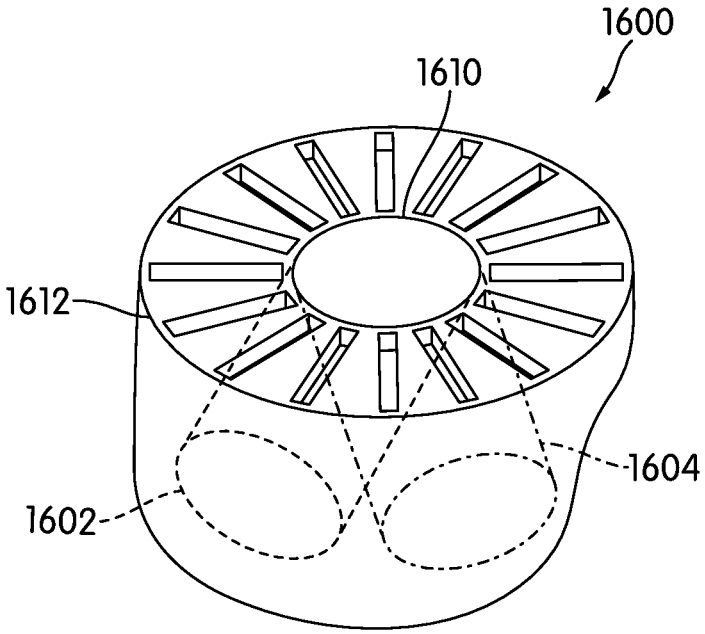
FIG. 23 is a schematic isometric view of an embodiment of a removable cleat member with multiple cavities.

FIG. 23 illustrates an embodiment of a removable cleat member having multiple cleat receiving cavities. Specifically, removable cleat member 1600 includes a first cleat receiving cavity 1602 and a second cleat receiving cavity 1604, which each extend from central opening 1610 at a base portion 1612 of removable cleat member 1600 towards a tallest portion of outer peripheral portion 1620. These two cavities may each receive a fastener. However, only one cavity may receive a fastener at a time, and which cavity receives the fastener will generally be determined according to the selected angular position of removable cleat member 1600 with respect to a corresponding cleat receiving portion (not shown).

Figure 24:
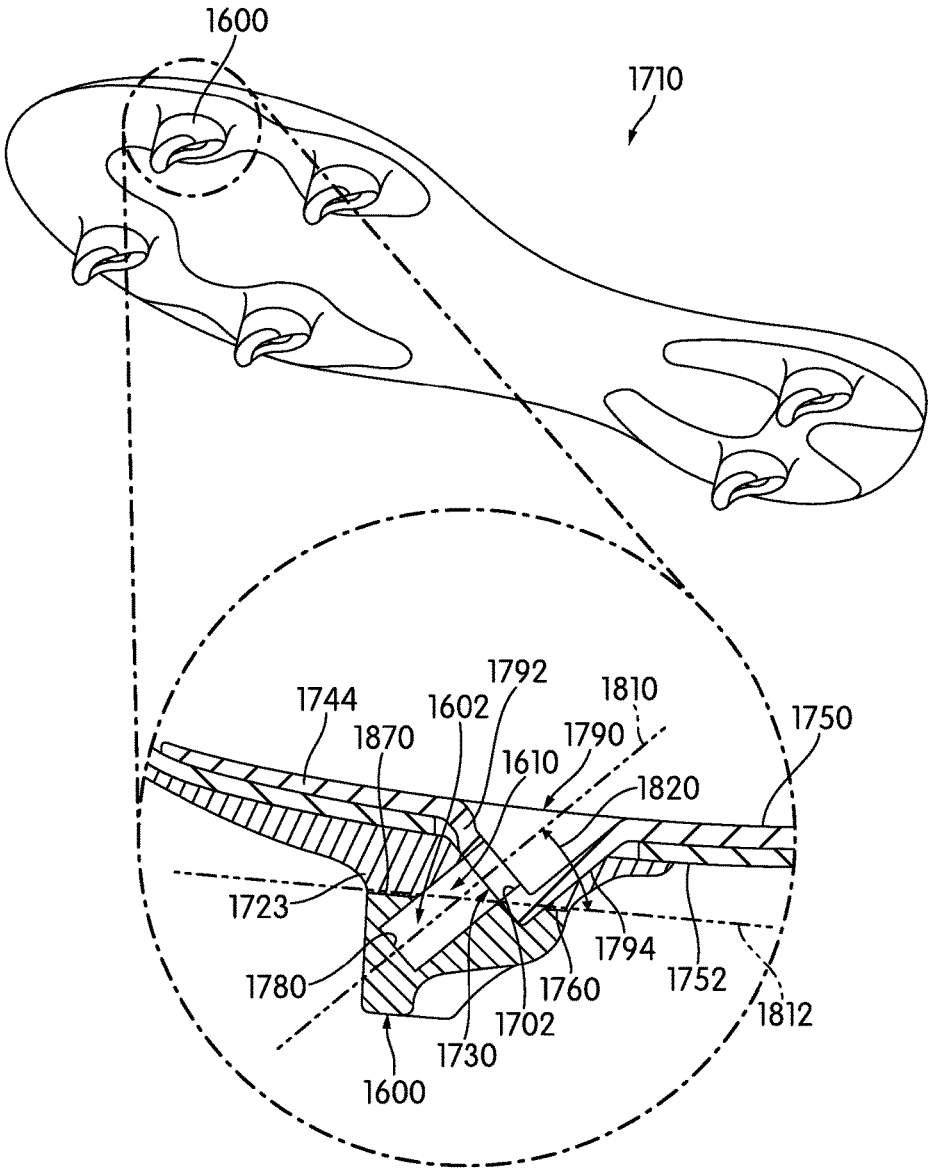
FIG. 24 is a schematic isometric bottom view of an embodiment of a sole structure and an enlarged cross-sectional view of the cleat member of FIG. 24 engaged with a cleat receiving portion.

FIG. 24 illustrates a schematic isometric side view of a sole structure 1710, including an enlarged cross-sectional view of a cleat receiving portion 1723 and removable cleat member 1600 prior to the insertion of a fastener. Referring to FIG. 24, cleat receiving portion 1723 includes opening 1730 that is aligned with opening 1610 and cavity 1602 of removable cleat member 1600. In this configuration, only cavity 1602 is aligned with opening 1730. However, in another angular configuration of removable cleat member 1600, cavity 1604 could be aligned with opening 1730. Moreover, in at least some embodiments, base plate 1744 may include an opening 1702 that is aligned with opening 1610 of cleat receiving portion 1723. This configuration allows for a fastener to be inserted through first side 1750 of sole structure 1710, through cleat receiving portion 1723 and into removable cleat member 1600.

In some embodiments, cavity 1602 of removable cleat member 1600 may be configured to engage a fastener. For example, in embodiments where a threaded fastener is used, cavity 1602 may comprise a socket in removable cleat member 1600 that is threaded in a corresponding manner to allow the fastener to be tightened within removable cleat member 1600. In embodiments where other fastening mechanisms are used, cavity 1602 may likewise comprise a socket with corresponding fastening provisions to receive a fastener. For example, in an alternative embodiment utilizing a fastener with projections or nubs, cavity 1602 may comprise a socket with indentations, grooves or similar provisions to receive the projections or nubs such that the fastener is temporarily anchored in place within removable cleat member 1600.

Figure 25:
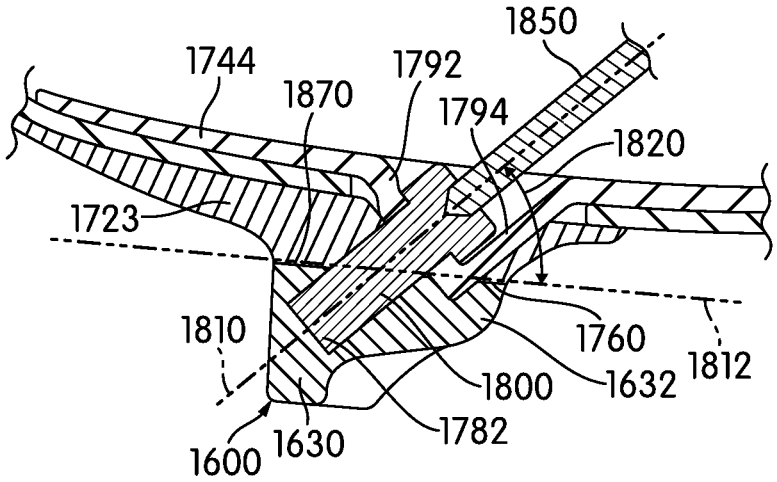
FIG. 25 is a schematic cross-sectional view of a portion of the sole structure of FIG. 24, in which a fastener has been inserted to fasten the cleat member to the cleat receiving portion.

FIG. 25 shows the enlarged view of FIG. 24 following the insertion of fastener 1800. As seen in FIG. 25, fastener 1800 may extend through base plate 1744, cleat receiving portion 1723 and removable cleat member 1600. As seen in FIG. 25, in some cases, fastener 1800 may be fastened in place using a fastening tool 1850. In at least some embodiments, fastening tool 1850 could be a screwdriver. In other embodiments, fastening tool 1850 could be any other kind of fastening tool including a wrench (such as an Allen wrench) or a key.

Embodiments can include provisions to improve the strength of a fastening connection between a removable cleat member and a sole structure. Some embodiments may utilize an angled orientation of a fastener with respect to a removable cleat member, which may allow more of the fastener to be disposed within the removable cleat member. In the embodiment shown in FIGS. 24 and 25, both cavity 1602 (e.g., a fastener receiving socket) of removable cleat member 1600 and fastener 1800 have angled orientations. More specifically, as shown in FIG. 24, cavity 1602 has a central axis 1810 that forms an angle 1820 with respect to a planar surface 1812 extending approximately in parallel with engaging surface 1870 of removable cleat member 1600 and engaging surface 1760 of cleat receiving portion 1723.

In addition, as shown in FIG. 25, a central axis of fastener 1800 is approximately aligned with central axis 1810 of cavity 1602. Therefore, fastener 1800 is also seen to form an approximate angle 1820 with engaging surface 1870 of removable cleat member 1600 and engaging surface 1760 of cleat receiving portion 1723.

Generally, the value of angle 1820 could vary from one embodiment to another. In some embodiments, angle 1820 may be an oblique angle. An oblique angle is an angle which is not a right angle, or not a multiple of a right angle. In at least one embodiment, angle 1820 has a value approximately in the range between 20 degrees and 70 degrees. However, in other embodiments, angle 1820 could be greater than 70 degrees or less than 20 degrees. Moreover, the value of angle 1820 may be selected according to various factors including the desired penetration depth of fastener 1800, the geometry of removable cleat member 1600, the geometry of cleat receiving portion 1723, the geometry of base plate 1744, a desired approach angle at which a user may insert fastener 1800 as well as possibly other factors.

To allow fastener 1800 to be inserted into removable cleat member 160 at an angle, the present embodiment shown in FIGS. 24 and 25 make use of a recessed portion 1790 of base plate 1744, which is configured to receive a fastener in an angled configuration. Specifically, recessed portion 1790 includes a first angled sidewall portion 1792 and a second angled sidewall portion 1794 that extend down from first side 1750 of sole structure 1710. First angled sidewall portion 1792 and second angled sidewall portion 1794 may have approximately similar lengths and/or heights relative to first side 1750. Moreover, first angled sidewall portion 1792 and second angled sidewall portion 1794 may meet at a lowest portion of recessed portion 1790. However, in the exemplary embodiment, opening 1702 of base plate 1744 is disposed in first angled sidewall portion 1792, but not second angled sidewall portion 1794. This configuration ensures that opening 1702 may be angled relative to a removable cleat member on second side 1752 of sole structure 1710. Angling opening 1702 in this manner ensures that fastener 1600 may be inserted at the desired angle through base plate 1744, cleat receiving portion 1723 and removable cleat member 1600.

As previously discussed, end portion 1780 of cavity 1602 is associated with the tallest portion of removable cleat member 1600. For example, end portion 1780 of cavity 1602 may be disposed in first arc portion 1630 of removable cleat member 1600, where first arc portion 1630 is taller (e.g., has a greater height) than a second arc portion 1632. Similarly, when inserted within removable cleat member 1600, fastener 1800 has an end portion 1782 (see FIG. 25) associated with the tallest portion (e.g., first arc portion 1630) of removable cleat member 1600.

Using an angled fastening configuration may allow for the use of a longer fastener, thereby increasing the length of the fastener that is disposed within a removable cleat member. Such a configuration may be especially useful for asymmetric cleats, or cleats with hollow central regions, since the volume of the cleat member that can be used to receive the fastener may be decreased in such instances.

The embodiment depicted in FIGS. 24-25 may utilize other provisions taught with respect to the previous embodiments and shown in FIGS. 1-13. For example, in some embodiments, removable cleat member 1600 and cleat receiving portion 1723 may include a radial locking system, including corresponding sets of radial locking elements. Further, as with previous embodiments, removable cleat member 1600 could be oriented in any direction and fastened in place in the desired orientation using fastener 1800. Still further, in other embodiments, the geometry of removable cleat member 1600 could vary in any manner. In at least some embodiments, removable cleat member 1600 could have a similar geometry to the geometry of removable cleat member 213 discussed previously and shown in FIGS. 3 and 4.

The exemplary embodiments depict a cleat system with cleat members that can be removed from a sole structure and re-fastened to the sole structure at a variety of different angular positions. It is contemplated that in some other embodiments, cleat members may not be completely removable, but instead may be loosened from a fixed angular position, rotated to a new desired angular position and then tightened to retain the new angular position. In such embodiments, cleat members may be tethered to a sole structure by a fastener or other provision such that the cleat members are never fully removed from the sole structure during their angular adjustment.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

a sole structure with a cleat receiving portion, the cleat receiving portion including a first cavity;

a removable cleat member configured to engage the cleat receiving portion, the removable cleat member including a second cavity;

a fastener configured to insert through the first cavity and into the second cavity, thereby releasably securing the removable cleat member to the sole structure; and a radial locking system, comprising:

a first plurality of radial locking elements extending from a first planar engaging surface of the cleat receiving portion and radiating from the first cavity toward an outer perimeter of the cleat receiving portion, the first plurality of radial locking elements each extending from a first terminal end to a second terminal end along a longitudinal axis that passes through the first cavity, the first terminal end spaced radially outwardly from the first cavity and the second terminal end spaced radially inwardly from the outer perimeter of the cleat receiving portion;

a second plurality of radial locking elements formed into a second planar engaging surface of the removable cleat member and radiating from the second cavity toward an outer perimeter of the removable cleat member, the second plurality of radial locking elements each extending from a third terminal end to a fourth terminal end along a longitudinal axis that passes through the second cavity, the third terminal end spaced radially outwardly from the second cavity and the fourth terminal end spaced radially inwardly from the outer perimeter of the removable cleat member;

wherein the first plurality of radial locking elements engages the second plurality of radial locking elements when the second planar engaging surface of the removable cleat member is disposed against the first planar engaging surface of the cleat receiving portion; and wherein the radial locking system restricts rotation of the cleat about a central axis of the removable cleat member, while the removable cleat member is fastened to the sole structure.

2. The article of footwear according to claim 1, wherein the first plurality of radial locking elements each includes a substantially rectangular shape.

3. The article of footwear according to claim 1, wherein the second plurality of radial locking elements matingly receive respective ones of the first plurality of radial locking elements.

4. The article of footwear according to claim 1, wherein the removable cleat member can be configured in a first angular position relative to the cleat receiving portion and temporarily locked into the first angular position using the fastener and wherein the removable cleat member can be configured in a second angular position relative to the cleat receiving portion and temporarily locked into the second angular position using the fastener, and wherein the first angular position is different from the second angular position.

5. The article of footwear according to claim 4, wherein fastening the removable cleat member to the cleat receiving portion using the fastener fixes the angular position of the removable cleat member.

6. The article of footwear according to claim 1, wherein the radial locking system helps prevent the removable cleat member from rotating relative to the cleat receiving portion when the removable cleat member is fastened against the cleat receiving portion.

7. The article of footwear according to claim 1, wherein the first planar engaging surface is in contact with the second planar engaging surface when the first plurality of radial locking elements are received within respective ones of the second plurality of radial locking elements.

8. The article of footwear according to claim 7, wherein the second plurality of radial locking elements matingly receive respective ones of the first plurality of radial locking elements.

9. The article of footwear according to claim 1, wherein the first plurality of radial locking elements are spaced apart from one another around a circumference of the cleat receiving portion by a first distance.

10. The article of footwear according to claim 9, wherein the second plurality of radial locking elements are spaced apart from one another around a circumference of the removable cleat member by a second distance.

11. The article of footwear according to claim 10, wherein the first distance is equal to the second distance.

12. The article of footwear according to claim 1, wherein the first plurality of radial locking elements are evenly spaced apart from one another around a circumference of the cleat receiving portion by a first distance.

13. The article of footwear according to claim 12, wherein the second plurality of radial locking elements are evenly spaced apart from one another around a circumference of the removable cleat member by a second distance.

14. The article of footwear according to claim 13, wherein the first distance is equal to the second distance.

15. The article of footwear according to claim 1, wherein the first plurality of radial locking elements include a square cross-sectional shape.

* * * * *